US006189169B1

(12) United States Patent
Marcotte

(10) Patent No.: US 6,189,169 B1
(45) Date of Patent: Feb. 20, 2001

(54) ADJUSTABLE WRAP FOR PILLOW USED FOR SUPPORTING BABY WHEN NURSING

(76) Inventor: Sherri Melinda Marcotte, #22 - 14141 104th Avenue, Surrey, British Columbia (CA), V3T 1X6

( * ) Notice: Under 35 U.S.C. 154(b), the term of this patent shall be extended for 0 days.

(21) Appl. No.: 09/492,091

(22) Filed: Jan. 27, 2000

(51) Int. Cl.[7] ..... A47G 9/00; A47C 20/02
(52) U.S. Cl. ..... 5/655; 5/490
(58) Field of Search ..... 5/655, 490, 636, 5/658, 652, 603

(56) References Cited

U.S. PATENT DOCUMENTS

| | | | |
|---|---|---|---|
| 4,383,713 | 5/1983 | Roston | 297/219 |
| 5,027,457 | 7/1991 | Sweet | 5/490 |
| 5,029,351 | 7/1991 | Weber | 5/655 |
| 5,154,649 | 10/1992 | Pender | 5/655 |
| 5,159,727 | 11/1992 | McCracken | 5/655 |
| 5,184,796 | 2/1993 | Maher | 248/104 |
| 5,224,637 * | 7/1993 | Colombo | 5/655 |
| 5,519,906 | 5/1996 | Fanto-Chan | 5/655 |
| 5,551,109 | 9/1996 | Tingley et al. | 5/655 |
| 5,581,833 | 12/1996 | Zenoff | 5/655 |
| 5,664,828 | 9/1997 | Simon | 297/153 |
| 5,790,999 | 8/1998 | Clark | 5/655 |
| 5,901,375 | 5/1999 | Davis | 2/69.5 |

* cited by examiner

*Primary Examiner*—Alexander Grosz
(74) *Attorney, Agent, or Firm*—Oyen Wiggs Green & Mutala

(57) ABSTRACT

This invention is directed to a novel, adjustable waterproof wrap which, among other uses, can be used to fold around a pillow for supporting a baby when nursing. The adjustable waterproof pillow wrap and enclosed pillow can be releasably attached or secured to a nursing mother and used to support the weight of the baby on the pillow while the baby is nursing. This relieves muscle fatigue on the upper body of the nursing mother. A pillow wrap comprising: (a) a flexible, soft web for encircling a pillow; (b) at least one elongated flexible member secured at one end to the web for encircling the waist of a mother; (c) a fastener associated with the elongated member for enabling the elongated member at a free end to be releasably secured to the web.

12 Claims, 5 Drawing Sheets

ADJUSTABLE WRAP FOR PILLOW USED FOR SUPPORTING BABY WHEN NURSING

Technical Field

This invention is directed to a novel, adjustable water resistant wrap which, among other uses, can be used to fold around a pillow for supporting a baby on a mother's lap when nursing. The adjustable water resistant pillow wrap and enclosed pillow can be releasably attached or secured to a nursing mother and used to support the weight of the baby on the pillow while the baby is nursing. This relieves upper body back strain on the nursing mother. The pillow wrap can also be used by nursing amputee mothers, paraplegic mothers, mothers with low upper body muscle strength, and other special needs nursing mothers.

BACKGROUND

Many mothers breastfeed their babies. Mothers' breast milk has been proven to be more beneficial to nursing babies than artificial milk formulations or cows' milk. To breastfeed a baby, the mother must hold the baby across her chest, or at the side under the arm, with the baby's head next to her breast. After feeding at one breast for fifteen to twenty minutes, the baby's body is reversed and the baby feeds at the other breast for fifteen to twenty minutes.

Usually, the mother must tilt her torso forward and to one side in order to assist the breastfeeding process. The nursing mother may also cross her legs in order to gain more elevation. These movements force the mother to bend her back forward, and to the side slightly. Holding the static weight of the baby, while nursing, also causes strain on the shoulders and back of the nursing mother. This can lead to poor posture and subsequent chronic backache problems for the mother. Mothers who have breastfed for many months frequently complain that they have to restructure their muscles and posture in order to carry themselves upright after having nursed a baby for that length of time.

Over the years, a number of patents have been granted for various inventions that relate to breastfeeding.

U.S. Pat. No. 4,383,713, Roston, granted May 17, 1983, discloses a support apparatus for infants. The apparatus comprises a planar sheet fabricated from a relatively high pile material to which a Velcro fastener can be secured. Located on the planar sheet is a pillow member having a central aperture and a dependent outer flange which angularly slopes towards the central aperture. The bottom surface of the pillow has a central section for accommodating the neck of a child. The underside of the pillow has a Velcro fastener to enable positioning of the same on the surface of the planar member. Also included are left and right lateral support members which are emplaced at the sides of an infant when his head is emplaced within the pillow. The lateral support members also have Velcro backings to enable them to be selectively positioned on the planar sheet.

This support apparatus is expensive and difficult to clean. Nursing babies frequently vomit and when this happens, the apparatus becomes soiled.

U.S. Pat. No. 5,027,457, Sweet, granted Jul. 2, 1991, discloses a pillow having extended arms and legs, the arms being semi-circular and of sufficient length to enable them to extend either around the neck or extend around the torso of a human body and enable the pillow to cling to the body and support the neck or back. The pillow, and/or an external pillow case or removable cover, can be decorated to make the pillow an ornamental design or caricature, as of a person or animal. The cover can simulate an article of clothing and is adapted to permit the arms and legs of the pillow to retain their initial appearance.

U.S. Pat. No. 5,029,351, Weber, granted Jul. 9, 1991, discloses a baby supporter and positioner that can be used by nursing mothers and any other person who wants to hold and interact with a baby on their lap while seated. The baby support pillow is wedge shaped to provide for a slightly inclined positioning of the baby and to provide for better alignment of the baby's head to the mother's breast. The baby support pillow has a contoured side to allow the pillow to cradle the person's body and provide a firm supportive surface close to the person's body for the baby.

U.S. Pat. No. 5,154,649, Pender, granted Oct. 13, 1992, discloses an inflatable nursing pillow having multiple air chambers which provide adjustability of air pressure and customized support for a child during bottle and breastfeeding. The device is anatomically shaped in a substantially yoke shaped configuration to extend around the user's torso and provide support for either left-handed or right-handed feeding. Each air chamber has an independent air valve to allow separate adjustment of air pressure. This adjustability allows customized support and adaptation for the size of the child, position of the user and child, and adaptation with chair arms, bed railings, or other physical constraints. The invention includes a removable elastic cover which provides a soft and moisture absorbent outer surface which can be easily changed and washed. The device is fully portable and can be deflated for storage or transportation and folded up into small dimensions for convenient carrying in a handbag or other suitable article.

A shortcoming with this nursing pillow design is that there is nothing which holds the pillow against the mother. Nursing babies wiggle and kick and hence the pillow tends to move away from the mother. In some instances, for example in the middle of the night, when the nursing mother is tired, she may doze off during the half to one hour feeding procedure and the pillow may fall off her lap, or the baby may fall between the pillow the mother. It is possible that the baby might suffocate because the inflatable plastic pillow does not transmit air.

U.S. Pat. No. 5,159,727, McCracken, granted Nov. 3, 1992, discloses a child care device including a pillow mounted on a baby blanket intermediate its ends. The ends of the blanket are provided with mating fastening means, one on one side of the blanket, one on the other. The blanket is wrapped around the baby holder's arm so that the pillow is on the upside and the baby's head rests thereon when the baby is being cradled by the baby holder. When the baby falls asleep it can be transferred to a crib mattress without disturbing it by placing its body on the mattress along with the pillow and removing the arm from beneath the pillow as by sliding it out. In an alternative embodiment, a sleeve mounting the pillow is utilized in lieu of a blanket.

U.S. Pat. No. 5,184,796, Maher, granted Feb. 9, 1993, discloses an apparatus which aids in the feeding of a baby while the baby is placed face-up on a substantially planar feeding surface to various levels of a sitting up position of approximately 45° in angle. The feeding apparatus is a triangular inflatable support system comprising two straps which encircle the chest under the arms of a baby for securing the entire apparatus to the baby, a strap to secure the bottle to the feeding apparatus and a valve element which inflates and deflates the hollow triangular chamber with air for the purpose of raising or lowering the height of the bottle to control the flow of the liquid into the mouth of the baby for proper feeding. While the primary object of the disclosed invention is for the feeding of a baby, this device can be used by any person who cannot hold a container because of any physical or mental impairment that would limit one's ability to feed oneself.

U.S. Pat. No. 5,519,906, Fanto-Chan, granted May 28, 1996, discloses a support pillow that is generally horseshoe or U-shaped with a generally pear-shaped cavity in the center and a means of fastening. When used in a horizontal position, the cavity is large enough to fit around the mid-section of a normal adult thus allowing for a back support with arm rests, a pregnancy pillow, a floor pillow for reading, sleeping or watching TV, or a nursing pillow. When the fastener is employed, the two tubular arms overlap at the ends forming a closed oval or donut shape. In this position, the pillow can support a small child in a sitting or reclining position. The pillow can also be used in a vertical position supporting both upper and lower back of the user. The pillow is filled with a soft pliable material making it extremely comfortable for all ages and because of the fastener, it is easy to carry.

U.S. Pat. No. 5,551,109, Tingley et al., granted Sep. 3, 1996, discloses a portable pillow for holding and cradling an infant that can be used by any person desiring to hold, feed, or cuddle the infant. The pillow can be held in a person's arms while sitting or standing, lay comfortably on someone's lap, or be placed on a flat surface, cradling the infant, without the need of holding the pillow. There is a recessed surface where the infant is placed, and overlapping straps that snugly hold the infant within the pillow. The straps are adjustable and held in place with fasteners, such a hook and loop. An inner foam core that is removable from the outer cover is made from two layers of foam with different densities. The top layer is soft for comfort while in contrast the bottom layer is firmer for support and structure. The pillow is portable, lightweight, and easy to hold and carry. Therefore it can be used as a portable bed. This will enable the infant to sleep securely and undisturbed, while the pillow is being held or carried.

U.S. Pat. No. 5,581,833, Zenoff, granted Dec. 10, 1996, discloses a support pillow which has a shape and construction that makes the support pillow particularly useful in situations in which it is necessary or desirable to have a support surface near the body of a user. The support pillow can be securely attached to the body to, for example, aid in supporting a baby during feeding, provide support of the elbows, forearms and wrists while reading or using a keyboard, or provide support for the forearms or external objects while engaging in an activity such as watching television or eating. The support pillow cushions and supports the back, and helps to hold the back in an orthopedically correct position. The support pillow also relieves muscle stress associated with holding a baby or other object by enabling the baby or object to be supported by the pillow. The support pillow is shaped to conform to the user's body and can be adjusted to have a fit of desired tightness so that the pillow remains stably and securely in place on the user (even when the user is standing or moving around), the back support of the pillow is enhanced and the pillow fits comfortably on the wearer.

U.S. Pat. No. 5,664,828, Simon, granted Sep. 9, 1997, discloses a device for support of two infants for simultaneous feeding thereof by a sole user and includes a rigid platform disposed on arms of a chair in which the user of the device is seated. A cushion is disposed on the rigid platform upon which the infants are supported for simultaneous feeding by the user of the device.

U.S. Pat. No. 5,790,999, Clark, granted Aug. 11, 1998, discloses a nursing pillow adapted for use with twins that can be used by anyone wishing to breastfeed or bottlefeed one baby, or two babies simultaneously. The design of the nursing pillow is generally a squared U-shape with symmetrical sides of equal length and firmness to accommodate the heads and bodies of two babies at once. The pillow can support growing babies from birth to two years old, or up to 70 pounds of total baby weight. The nursing surface preferably has an inwardly-angled slope so babies roll naturally and safely towards the user. A detachable back pillow may be included to provide lower and mid-back support for the user.

U.S. Pat. No. 5,901,375, Davis, granted May 11, 1999, discloses a multi-purpose garment which has an elongated, rectangular first sheet. The first sheet has an inside surface, an outside surface, a pair of short sides and a pair of long sides. A hood has a bottom edge attached at a central position along one of the long sides of the first sheet. A first pocket is disposed on the inside of the first sheet and opens towards the hood at a central position along the one long side of the first sheet. The first pocket is positioned and sized to receive the hood folded therein. A reversible second pocket is disposed on the outside of the first sheet and opens away from the hood at a central position along the one long side of the first sheet and the second pocket is sized to receive the first sheet folded therein.

SUMMARY OF INVENTION

The invention is directed to a pillow wrap for nursing mothers comprising: (a) a flexible, soft web for enveloping a pillow; (b) at least one elongated flexible member secured at one end to the web for encircling the waist of a mother; (c) a fastener associated with the elongated member for enabling the elongated member at its free end to be releasably secured to the web.

The pillow wrap can include a pair of elongated members associated with the web, each elongated member having a fastener for securing the end of each elongated member to the web. The elongated members can be straps with snap fasteners located at the distal ends of each strap, and a mating snap for each strap snap can be located on the web.

The web can be rectangular in shape and can be formed of a water resistant fabric. The web can be constructed of washable flannel cloth and a water resistant fabric, laminated together.

At least two mating straps can be secured to one side of the rectangular fabric, the two straps encircling in criss-cross fashion the waist of a nursing mother when the snap fasteners at the ends of each strap are secured to the respective snaps on the rectangular fabric. First and second sets of mating snap fasteners can be secured to first and second sides of the rectangular fabric.

The water resistant fabric can include at least one pair of releasable fasteners at each end for enabling the fabric to be enclosed about a pillow and secured by the releasable fasteners.

The pillow wrap can include a pocket on one side of the fabric. The pillow wrap can include a series of snaps situated on the fabric, the series of snaps enabling the size of the enclosure created when the two straps are secured to the fabric to be adjusted by selecting an appropriate snap to which the mating snap on the strap can be releasable secured.

The length of the elongated member can be adjusted. The width of the rectangular fabric can be sufficiently wide to accommodate two adjacent pillows.

BRIEF DESCRIOPTION OF DRAWINGS

In drawings which illustrate specific embodiments of the invention, but which should not be construed as restricting the spirit or scope of the invention in any way:

DETAILRD DESCRIPTION

Figure 1:
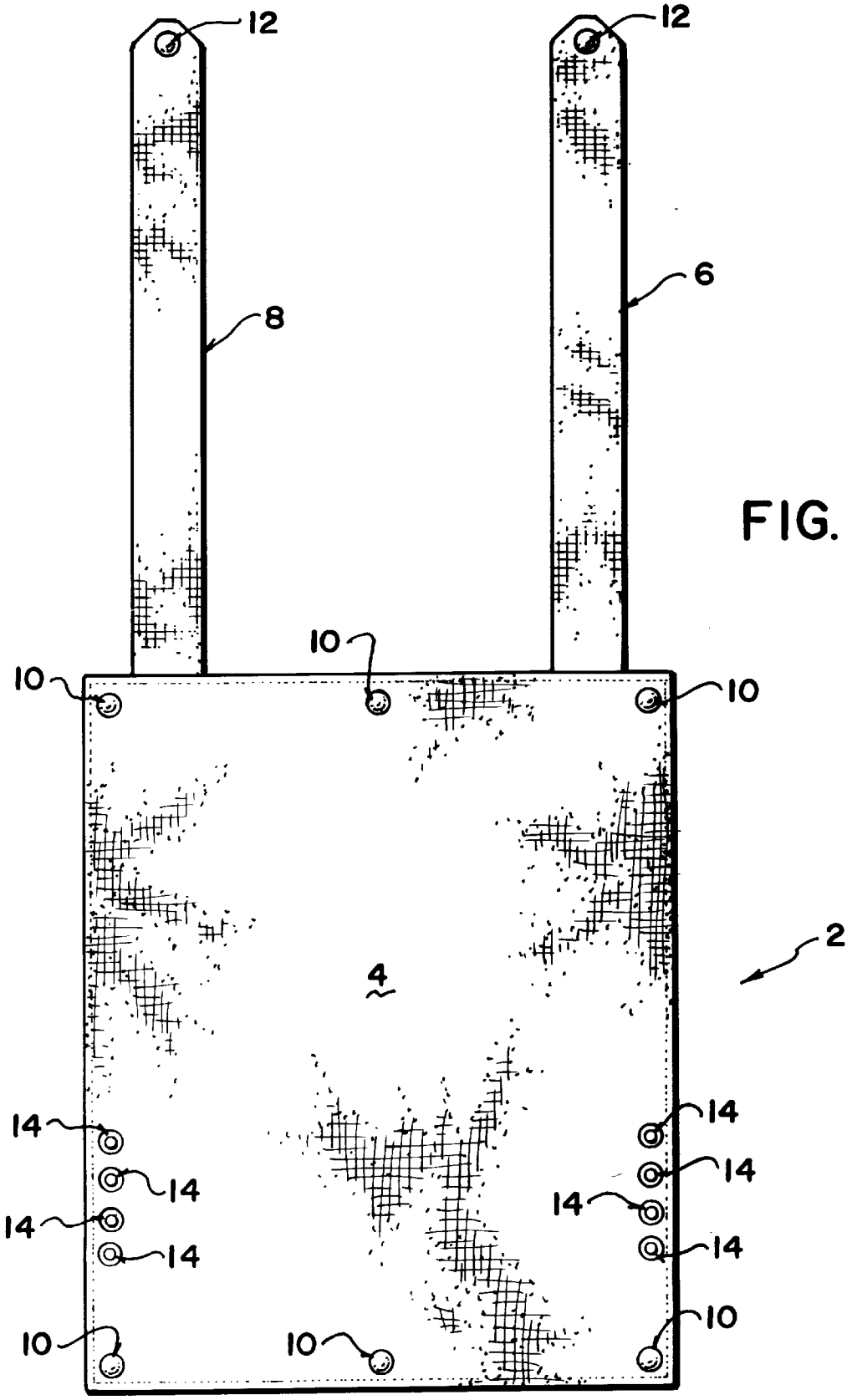
FIG. 1 illustrates a front view of the pillow wrap according to the invention.

Referring to the drawings, FIG. 1 illustrates a front view of the pillow wrap 2 according to the invention. As seen in FIG. 1, the pillow wrap is constructed of a rectangular body 4, with a pair of elongated straps 6 and 8 extending upwardly from one side of the rectangular body 4 of the pillow wrap 2. The pillow wrap is constructed of a suitable soft cloth, preferably flannelette or some other soft cloth, on one side, and a waterproof or water resistant backing on the other side. The pillow wrap should be washable and stand up to repeated washing because babies frequently vomit and the pillow wrap can become soiled. The lengths of the first strap 6 and second strap 8 are sufficiently long to enable the straps 6 and 8 to extend around the waist including the lower back of a nursing mother. A triple set of pillow snaps 10 are located at the top region of the body 4 and a triple set of pillow straps 10 are located at the bottom region of the rectangular body 4. These top and bottom sets of pillow snaps 10 are respectively snapped together in order to enclose any typical pillow(s).

The ends of the first strap 6 and the second strap 8 remote from the body 4 have respective strap snaps 12 installed therein. Located along each lateral side of the rectangular body 4 are a series of waist length adjustment snaps 14. The series of waist length adjustment snaps 14 enable the first strap 6 and second strap 8 and the rectangular body 4 to accommodate different waist sizes of nursing mothers. The nursing mother simply selects the appropriate pair of waist adjustment snaps 14 that is best suited to her waist size and baby weight support needs.

The straps 6 and 8 should be made of a strong woven fabric such as nylon, or the like, and should be sufficiently wide to provide a certain amount of pressure on the lower back muscles of the nursing mother.

Nursing babies usually require fifteen to thirty minutes on each breast, depending on baby size and age. Holding the weight of the baby for these lengths of time, and in a bent over, and slightly twisted position, places a considerable amount of strain on the upper body of the mother. The weight of the baby is static and it is difficult for anyone, let alone a nursing mother, to hold the weight of the baby, which can be anywhere from 6 to 20 pounds, in one position for fifteen to thirty minutes.

The pillow wrap according to the invention, by enclosing a pillow, not only assists in supporting the weight of the baby, but also, by way of the two criss-crossing straps 6 and 8, applies deep pressure to the small back muscles, which tend to become easily fatigued. Physical therapy specialists have determined in recent years that applying deep pressure to muscles which are under strain is very beneficial. Progressive weakness in muscle strength and muscle soreness can be avoided or minimized by the application of deep pressure to the affected area.

The respective first strap 6 and second strap 8 must be capable of supporting the weight of the baby. Preferably, the straps should be at least two inches wide to provide even pressure to the small back muscle area. These straps 6 and 8 are securely attached to the top region of the rectangular body 4 by strong strap stitching 18.

Figure 2:
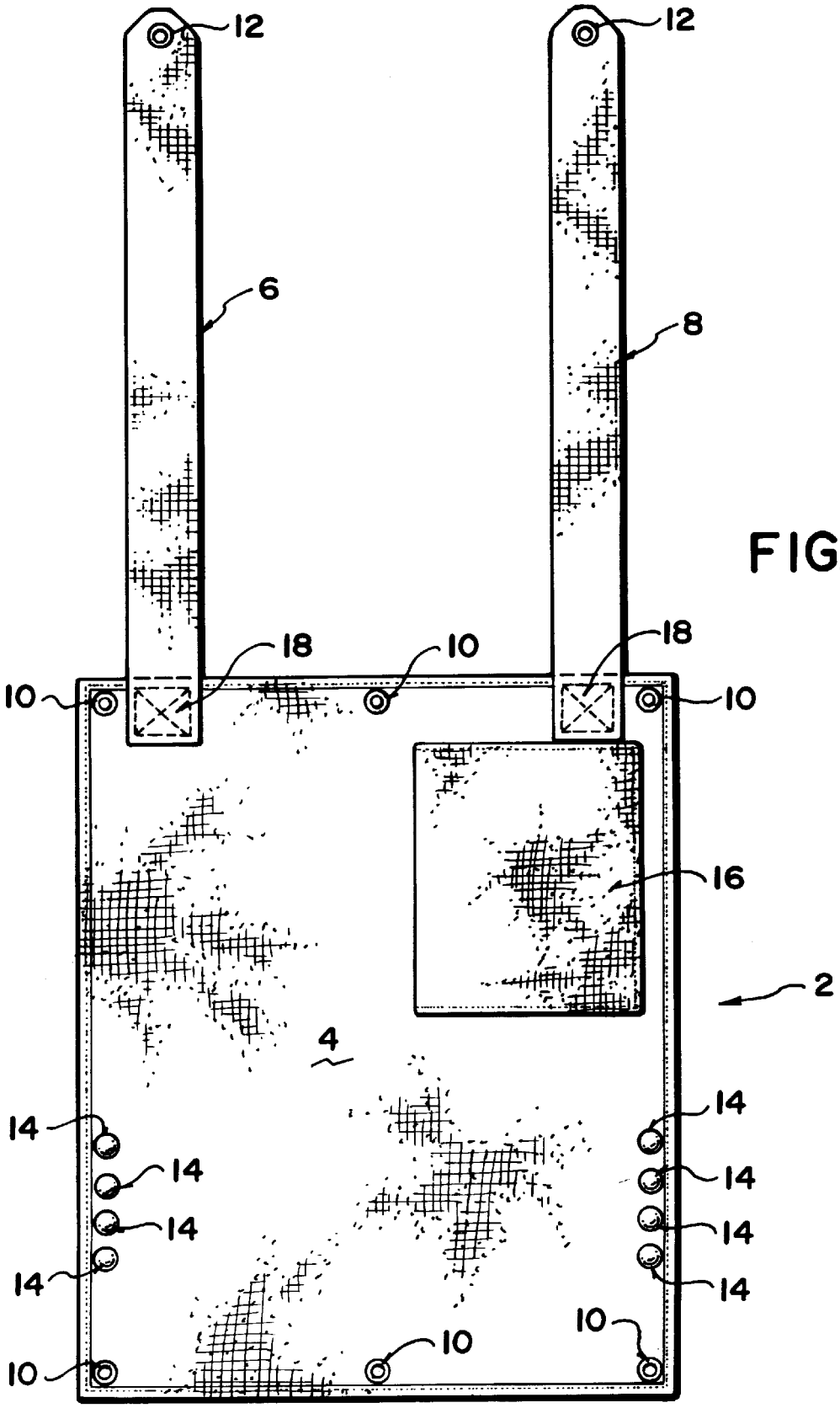
FIG. 2 illustrates a rear view of the pillow wrap according to the invention.

FIG. 2 illustrates a rear view of the pillow wrap 2, including the rectangular body 4, the first and second straps 6 and 8, the pair of trios of pillow snaps 10 located at the respective top and bottom regions of the rectangular body 4, the strap snaps 12 located at the ends of the first and second straps 6 and 8, and the series of waist length adjustment snaps 14, located at each lateral side of the rectangular body 4. FIG. 2 also illustrates a pocket 16 which the mother can use to conveniently hold two or three diapers, a receiving blanket, travel cream, travel wipes, and other baby accessories.

Figure 3:
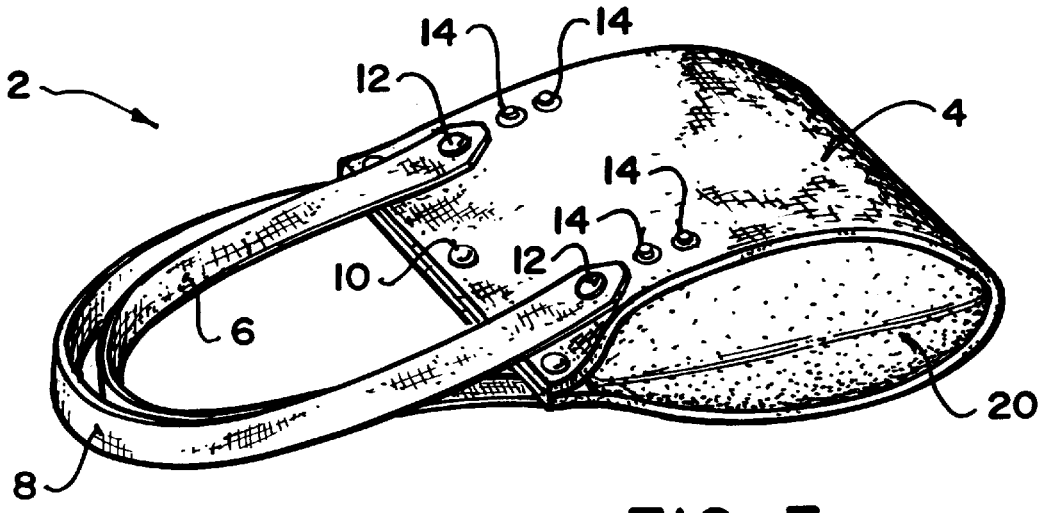
FIG. 3 illustrates an isometric view of the pillow wrap installed on a blanket, with back straps snapped in place on the pillow wrap.

FIG. 3 illustrates an isometric view of the pillow wrap installed on a pillow, with the ends of the back straps 6 and 8 snapped in place in criss-cross fashion, on the pillow wrap. As seen in FIG. 3, the rectangular body 4 has been doubled on itself to enclose the pillow 20. The respective pillow snaps 10 at the top and bottom regions of the body 4 are first snapped together in order to enclose the pillow 20. Then the free ends of the first strap 6 and the second strap 8 are passed in criss-crossed fashion around to form an enclosure and support in both directions for the waist of the nursing mother. One strap can be used, but the inventor has found that two criss-crossed straps are preferable to provide stability and apply consistent deep pressure to the small back of the nursing mother. Each strap 6, 8 has been snapped by respective snaps 12 onto the appropriate waist adjustment snap 14, best suited to accommodate the waist size of the nursing mother.

Figure 4:
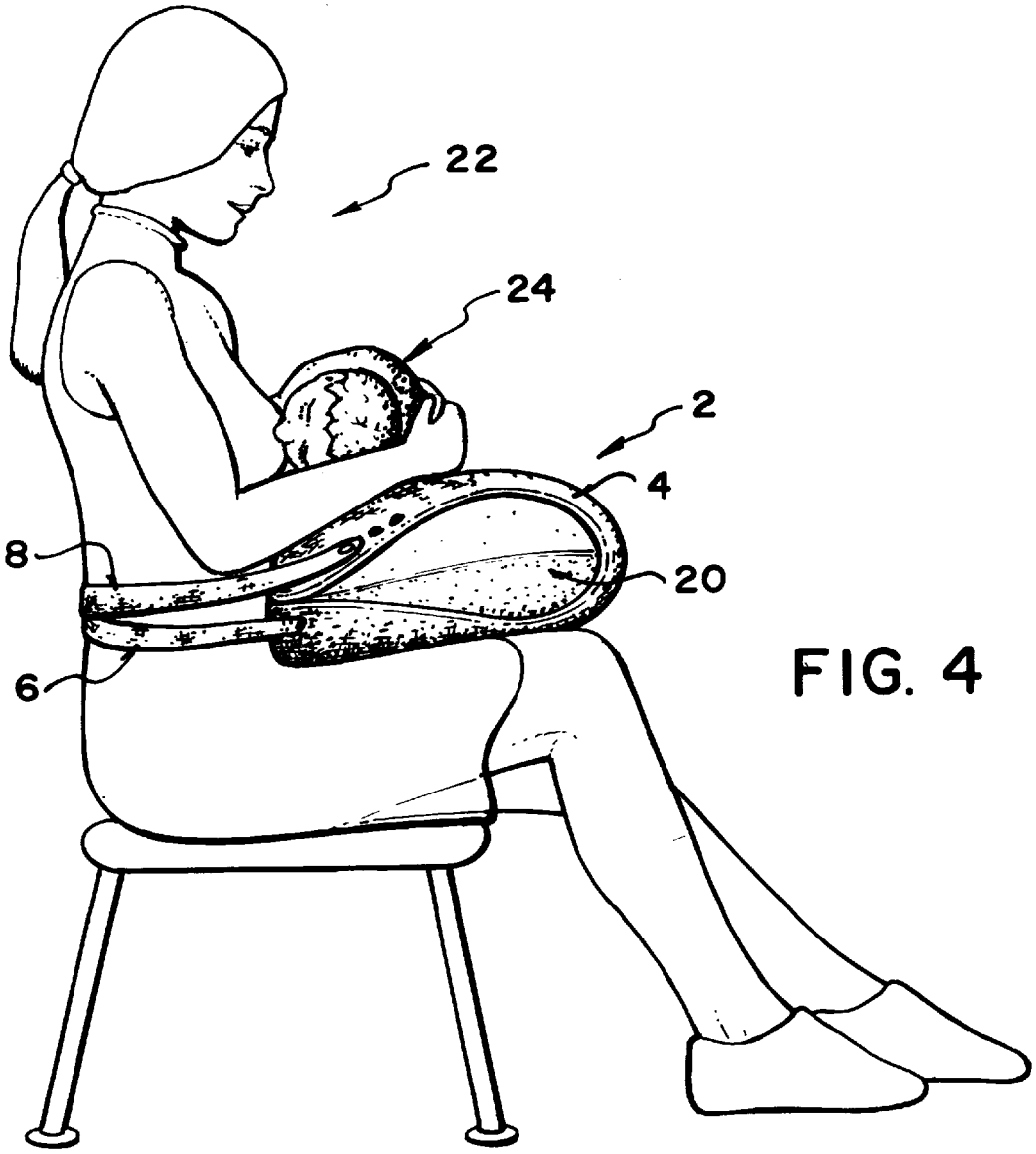
FIG. 4 illustrates a side view of a mother with the pillow wrap according to the invention and a supporting pillow enclosed in the pillow wrap with a baby resting on the pillow wrap and pillow.

FIG. 4 illustrates a side view of a nursing mother with the pillow wrap according to the invention and a supporting pillow 20 enclosed in the pillow wrap 4 with a baby 24 resting on the pillow wrap and pillow. As seen in FIG. 4, the pillow 20 and rectangular body 4 encircling the pillow rests on the lap of the nursing mother 22. The first and second straps 6, 8 are strapped together in criss-cross fashion around the sides and small of the back of the waist of the nursing mother 22. The nursing baby 24 can then rest at breast height on the pillow 20 and the encircling rectangular body 4 of the pillow wrap 2 without requiring the mother to lean forward and thereby placing a strain on her back. Also, since all of the static weight of the nursing baby 24 is absorbed by the pillow 20, and the lap of the mother, no weight is transferred to the back area of the nursing mother 22 and accordingly development of upper body fatigue, including small of the back fatigue, and possibly chronic back problems is avoided. The crisscrossing straps 6 and 8 provide a deep pressure to the muscles of the lower back, which as physiotherapists have demonstrated, is beneficial to working muscles. The crisscrossed straps 6 and 8 also provide lateral stability in each direction and hold the wrap 4 and pillow 20 in position. There is no possibility of the baby falling between the pillow 20 and the front waist area of the mother.

Figure 5:
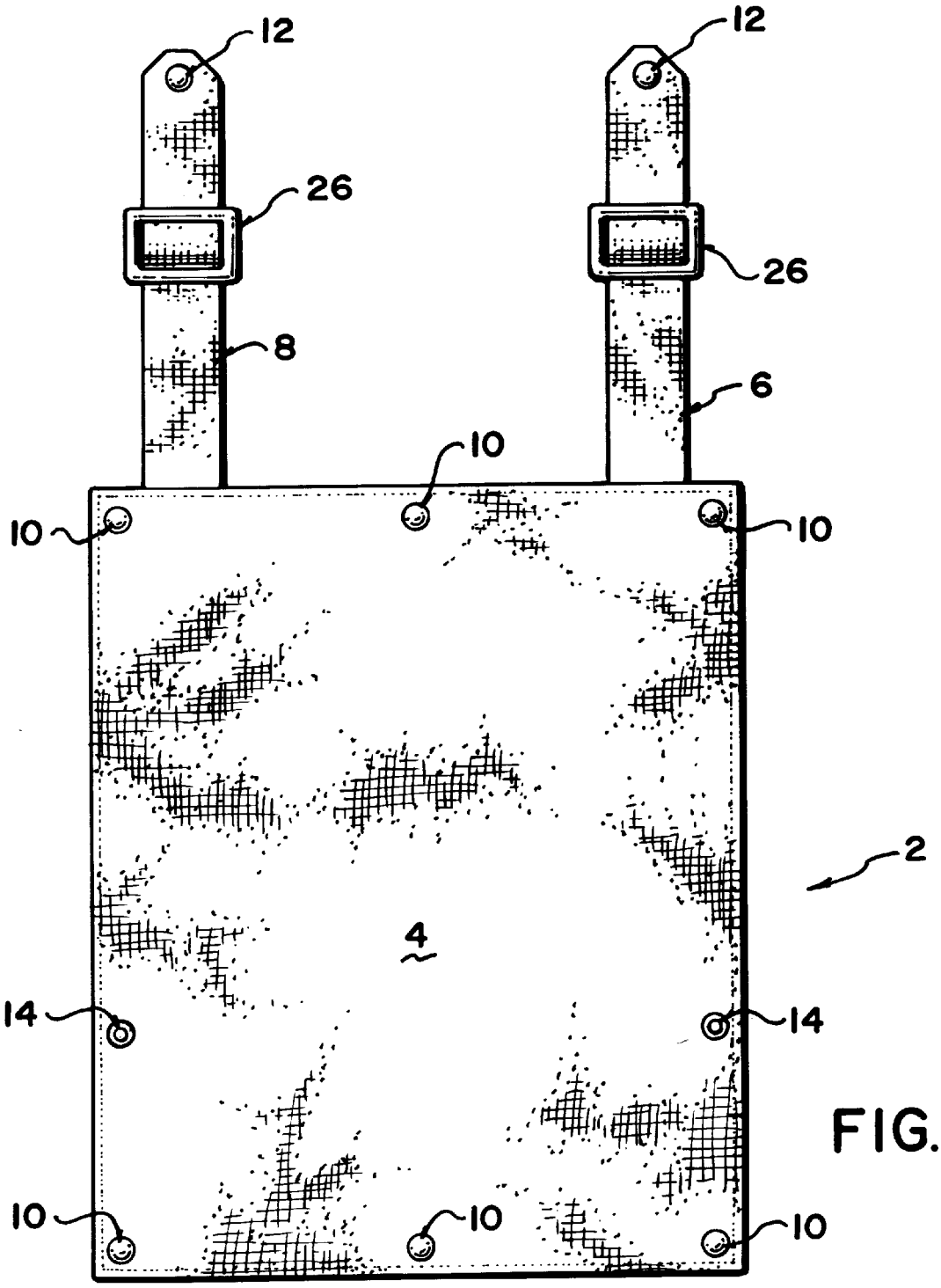
FIG. 5 illustrates a front view of a second embodiment of the pillow wrap with adjustable length back straps.

FIG. 5 illustrates a front view of a second embodiment of the pillow wrap with adjustable length back straps. As seen in FIG. 5, the straps 6 and 8 are adjustable in length because they have respective buckles 26, which permit the straps 6 and 8 to be doubled back on one another and the lengths of the straps set by adjusting the degree of back doubling. Further, since the lengths of the straps 6 and 8 can be adjusted, it is necessary to have only one snap 14 on each side of the wrap body 4.

Figure 6:
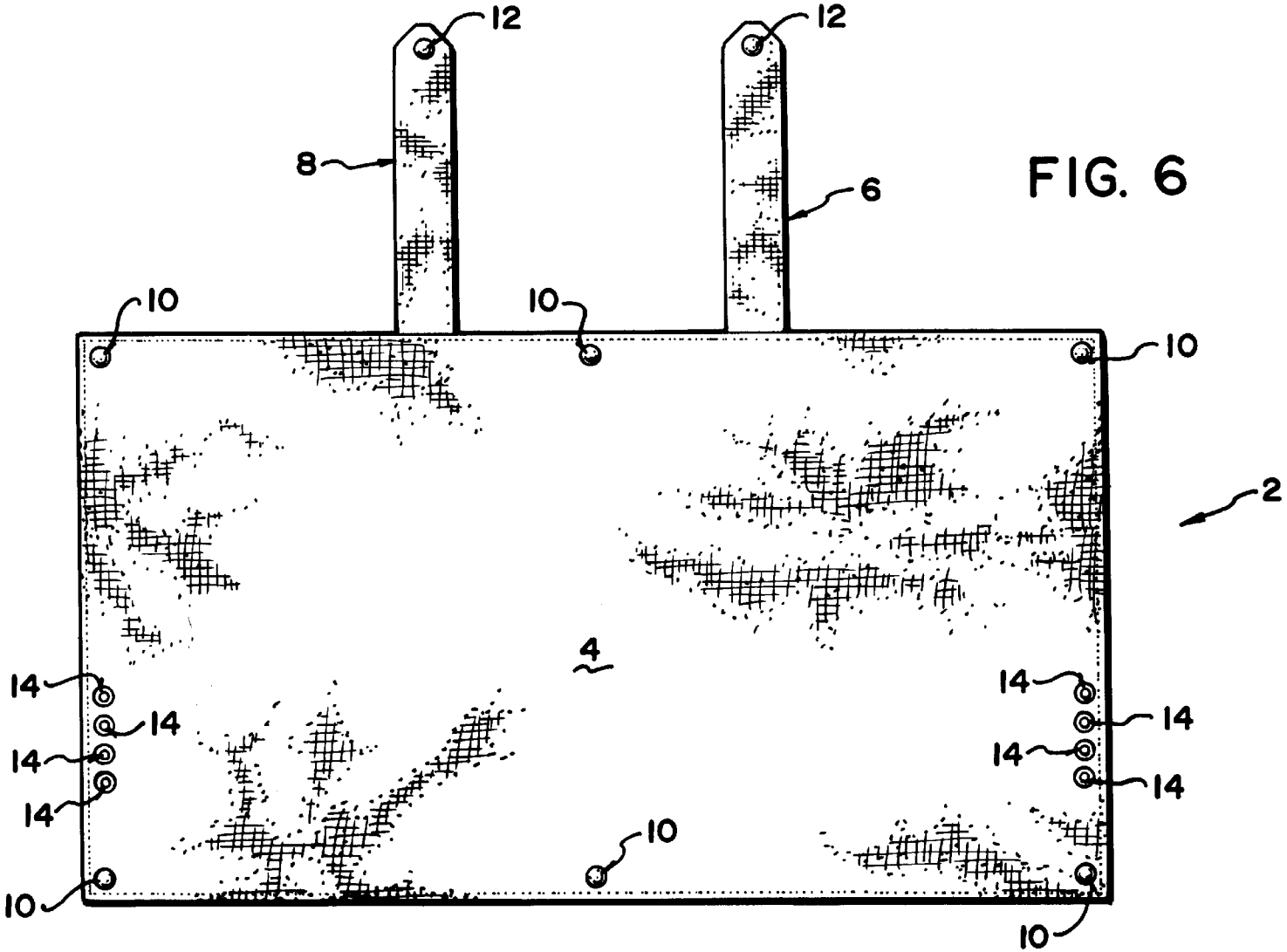
FIG. 6 illustrates a front view of a third embodiment of the pillow wrap, adapted for use with two pillows, and nursing twins.

FIG. 6 illustrates a front view of a third embodiment of the pillow wrap, adapted for use with two pillows, and nursing twins. Sometimes, a mother bears twins. In such cases, with the pillow wrap design illustrated in FIG. 6, it is possible to nurse both babies at the same time. The wrap 4 is twice as long as normal in order to enfold two adjacent pillows (not shown). The two pillows and the wrap 4 are sufficiently flexible that they can be bent around the front waist area of the nursing mother.

The pillow wrap according to the invention assists nursing mothers in the breastfeeding process and absorbing the weight of the breast feeding baby. The pillow wrap is readily portable and can be put around any standard shape bed pillow and releasably fastened around the waist of the mother. The weight of the baby is a static weight that the mother must endure for periods of fifteen to thirty minutes per breast. The pillow wrap helps support the baby so that the shoulders and back of the mother do not have to carry all of the static weight of the baby. It also assists the mother in angling herself for the breastfeeding process. The straps hold the pillow and wrap against the front waist of the mother so the baby cannot slip between the pillow and the mother. The crisscrossed straps provide muscle relaxing deep pressure to the small back of the mother.

The pillow wrap has other uses as well. The pillow wrap is waterproof or water resistant and has a soft absorbent side. It can be used as a diaper changing mat. By placing the pillow wrap flat down on a safe flat area with the soft side up, it provides a clean and comfortable surface for changing the diaper of a baby.

A third use for the pillow wrap is as a nap mat cover. When the baby becomes a toddler, there is no need to discard the pillow wrap because it can then be used as a clean, soft, removable cover for whatever surface the toddler naps on. In this way, the mother knows that her child is napping on something familiar and clean. The pillow wrap can have attractive patterns on it and the baby learns to recognize the pattern and feels secure when the pillow wrap is used as a nap cover.

The fourth use is as a mini diaper bag. The pocket on the reverse side of the pillow wrap is large enough to hold two or three diapers, a receiving blanket, travel cream and travel wipes. In this way, the mother need not carry a separate large and bulky bag for small trips to a neighbour or friend, or during the course of running errands, with the baby along.

The pillow wrap according to the invention is also extremely helpful to nursing mothers who have had an arm amputated, or are paraplegic, or have low upper body strength.

EXAMPLE

A mother, Nicole, who was twenty-six years of age, had her left arm amputated for health reasons. Later, Nicole became pregnant and delivered her baby at the Royal Columbian Hospital in New Westminster, British Columbia, Canada. Initially, Nicole had made a decision that to avoid a stressful situation, she would not breastfeed her baby. However, Pauline, a lactation consultant at the Royal Columbian Hospital, introduced a prototype of the pillow wrap to Nicole. Nicole found that the pillow wrap with the supporting straps was easy to use and thereafter, she started breastfeeding her baby using the pillow wrap.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pillow wrap for nursing mothers comprising:

(a) a flexible, soft generally planar web, adapted to be folded around a pillow to releasably retain the pillow within the folded web, said pillow sized to support a nursing infant;

(b) at least one elongated flexible member secured at one end to the web for encircling the waist of a mother;

(c) a fastener associated with the elongated member for enabling the elongated member at its free end to be releasably secured to the web.

2. A pillow wrap as claimed in claim 1 including a pair of elongated members associated with the web, each elongated member having a fastener for securing the end of each elongated member to the web.

3. A pillow support as claimed in claim 2 wherein the elongated members are straps with snap fasteners located at the distal ends of each strap, and a mating snap for each strap snap located on the web.

4. A pillow wrap as claimed in claim 3 wherein the web is rectangular in shape and is formed of a water resistant fabric.

5. A pillow wrap as claimed in claim 4 wherein the web is constructed of washable flannel cloth and a water resistant fabric, laminated together.

6. A pillow wrap as claimed in claim 5 wherein the water resistant fabric includes at least one pair of releasable fasteners at each end for enabling the fabric to be enclosed about a pillow and secured by the releasable fasteners.

7. A pillow wrap as claimed in claim 4 wherein at least two mating straps are secured to one side of the rectangular fabric, the two straps encircling in criss-cross fashion, the waist of a nursing mother when the snap fasteners at the ends of each strap are secured to the respective snaps on the rectangular fabric.

8. A pillow wrap as claimed in claim 7 including a pocket on one side of the fabric.

9. A pillow wrap as claimed in claim 4 wherein first and second sets of mating snap fasteners are secured to first and second sides of the rectangular fabric.

10. A pillow wrap as claimed in claim 4 including a series of snaps situated on the fabric, the series of snaps enabling the size of the enclosure created when the two straps are secured to the fabric to be adjusted by selecting an appropriate snap to which the mating snap on the strap can be releasable secured.

11. A pillow wrap as claimed in claim 4 wherein the width of the rectangular fabric is sufficiently wide to accommodate two adjacent pillows.

12. A pillow wrap as claimed in claim 1 wherein the length of the elongated member can be adjusted.

* * * * *